US007883446B2

(12) United States Patent
Lovley, II

(10) Patent No.: US 7,883,446 B2
(45) Date of Patent: Feb. 8, 2011

(54) TRAMPOLINE ENCLOSURE WITH ACCESS DOOR

(75) Inventor: Jack B. Lovley, II, Lake Forest, CA (US)

(73) Assignee: Bravo Sports, Santa Fe Springs, CA (US)

( * ) Notice: Subject to any disclaimer, the term of this patent is extended or adjusted under 35 U.S.C. 154(b) by 523 days.

(21) Appl. No.: 11/773,313

(22) Filed: Jul. 3, 2007

(65) Prior Publication Data

US 2008/0269019 A1 Oct. 30, 2008

Related U.S. Application Data

(60) Provisional application No. 60/913,991, filed on Apr. 25, 2007.

(51) Int. Cl.
*A63B 21/00* (2006.01)

(52) U.S. Cl. ..... 482/27; 482/28

(58) Field of Classification Search ..... 482/27, 482/28; 135/90–128; 182/24; 160/135; 52/234

See application file for complete search history.

(56) References Cited

U.S. PATENT DOCUMENTS 2,999,558 A * 9/1961 Bohrer, Sr. ..... 482/27
4,077,623 A 3/1978 Clausell
4,380,327 A 4/1983 Fish
4,433,838 A 2/1984 Gordon
4,478,420 A 10/1984 Sowards
4,596,515 A 6/1986 Simon et al.
5,063,876 A 11/1991 Harris
5,102,103 A 4/1992 Putnam
5,229,781 A 7/1993 Losquadro et al.
5,395,105 A 3/1995 Thommon, Jr.
5,399,132 A 3/1995 Bailey
5,624,122 A 4/1997 Winkelhorn
6,053,845 A 4/2000 Publicover et al.
6,261,207 B1 7/2001 Publicover et al.
7,047,992 B1 * 5/2006 Fluellen ..... 135/98
2002/0137598 A1 * 9/2002 Publicover et al. ..... 482/27

FOREIGN PATENT DOCUMENTS

JP 8-47550 8/1994
JP 9-84896 3/1997

OTHER PUBLICATIONS

Published pictures 1987.
Published Pictures 1979.

* cited by examiner

*Primary Examiner*—Jerome Donnelly
(74) *Attorney, Agent, or Firm*—Holland & Hart LLP

(57) ABSTRACT

A trampoline and enclosure with an improved ingress and egress is provided. The enclosure is made from a flexible material with an arched entry way. The entry way is arched, or some other shape (symmetrical or asymmetrical), so that when it is in the open position, the material closing the arch falls out of the way facilitating ingress and egress to the jumping chamber.

11 Claims, 5 Drawing Sheets

TRAMPOLINE ENCLOSURE WITH ACCESS DOOR

CLAIM OF PRIORITY UNDER 35 U.S.C. §119

This application claims priority to U.S. Provisional Patent Application Ser. No. 60/913,991, title TRAMPOLINE ENCLOSURE WITH ARCHED ACCESS DOOR, incorporated herein by reference as if set out in full.

CLAIM OF PRIORITY UNDER 35 U.S.C. §120

None.

REFERENCE TO CO-PENDING APPLICATIONS FOR PATENT

None.

BACKGROUND

1. Field

The technology of the present application relates generally to safety enclosures for trampolines, and more specifically to an arched access door for a safety enclosure to facilitate ingress and egress.

2. Background

A trampoline provides a frame having a taut mat coupled to the frame using elastically biased members. A user can stand on the mat and perform various solo or group jumping maneuvers. Trampolines may be used for fun and recreation as well as for training, such as, for extreme skiing.

Trampolines, however, come with many unique safety issues. One issue is falling off of the trampoline. Moreover, the younger the user the more likely the user is to be injured by failing off of the trampoline. Therefore, many owners of trampolines feel it is necessary to provide a safety enclosure to inhibit falling from the trampoline.

Many styles of safety enclosures exist. One such enclosure is described in U.S. Pat. No. 6,607,468, issued to Nichols, Jr. et al. In particular, Nichols shows a trampoline having a frame and a jumping mat connected to the frame via a plurality of sprints. The frame has a plurality of poles extending above the frame to which a flexible member, typically a mesh fabric or plastic, is attached using ties, springs, clips or the like. The poles may be wrapped with a foam sleeve for safety. The enclosure facilitates stopping a user from unintentionally falling off of the jumping surface. Some enclosures function to positively move the user (or jumper) from the edge. Other enclosures function to stop the movement of the user.

The enclosure needs to have an access point to allow ingress and egress from the jumping surface. Some enclosures, such as Nichols, Jr. above, provide a vertical slit at a point in the enclosure. Generally, the vertical slit is formed at a leading and trailing edge of the enclosure to form a single entry, exit point. In some cases, the leading and trailing edges may overlap to inhibit unintentional exiting from the jumping area. To meet ASTM standards, the leading and trailing edges may be connected via a coupling device, such as, for example, corresponding hook-and-loop material, zippers, snaps, ties, or the like. Some enclosures include both a vertical slit and a horizontal slit. In these cases, a flap opens in the enclosure wall.

In both cases, ingress and egress are difficult as the material associated with the entrance remains essentially in the way of the user and must be moved to provide entry. While ingress is not overly difficult even with the fabric in the way as one is stabile on a stationary platform. Egress through the conventional access ports is relatively difficult as the user is trying to exit from an unstable surface. Thus, the possibility of tripping and falling out of the entry/exit point may be increased.

Thus, it would be desirable to provide a trampoline enclosure with an improved entry/exit point to address these and other deficiencies in the art.

SUMMARY

The foregoing and other features, utilities and advantages of the invention will be apparent from the following more particular description of a preferred embodiment of the invention as illustrated in the accompanying drawings.

DETAILED DESCRIPTION

The technology of the present application will be described with reference to an enclosure for a recreational trampoline. One of ordinary skill in the art would recognize that the enclosure could be used in other situations. Moreover, the technology of the present application will be described with reference to certain exemplary embodiments. The word "exemplary" is used herein to mean "serving as an example, instance, or illustration." Any embodiment described herein as "exemplary" is not necessarily to be construed as preferred or advantageous over other embodiments. Moreover, unless specifically so stated, all embodiments discussed and disclosed herein should be considered exemplary.

Figure 1:
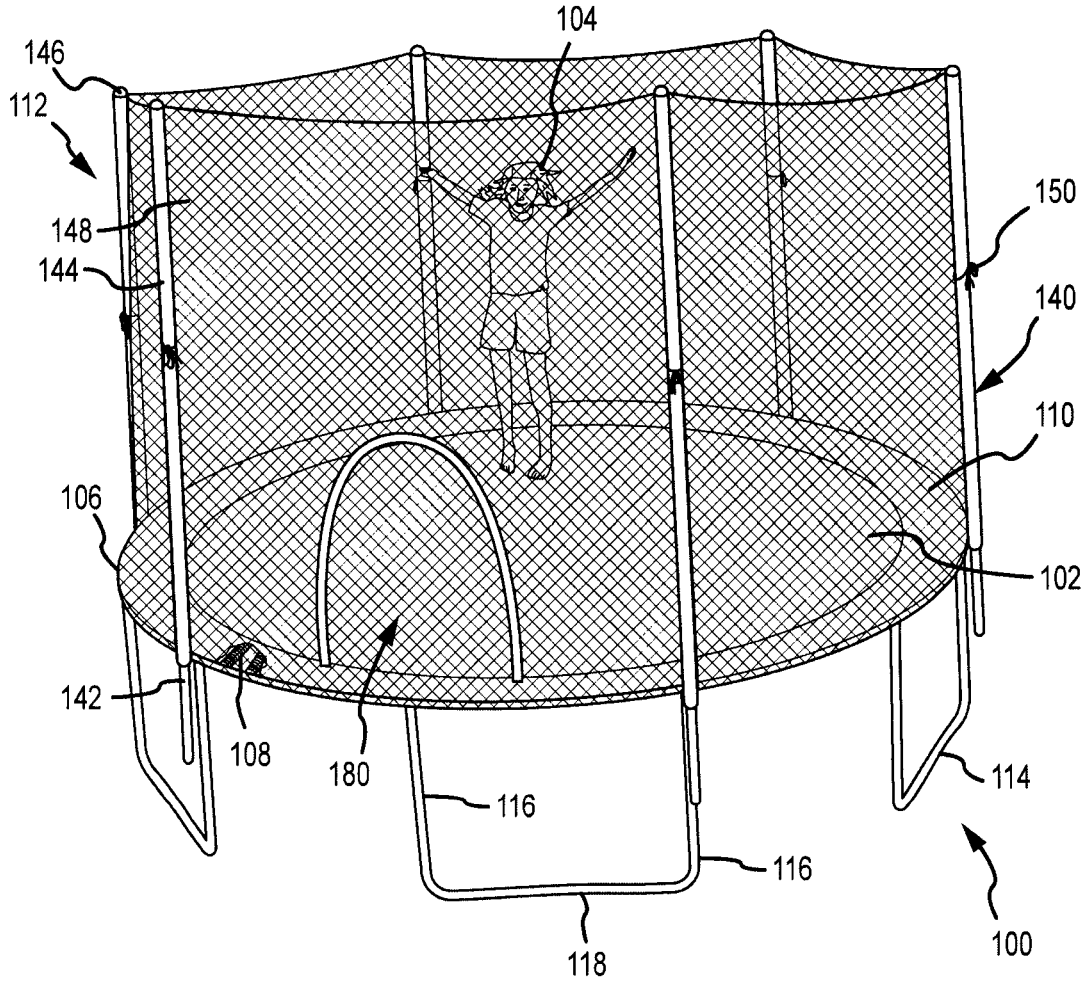
FIG. 1 is a top perspective view of one embodiment of a trampoline with an enclosure using technology of the present application.

Referring first to FIG. 1, a top perspective view of a trampoline 100 having an enclosure 140 with an entry/exit 180 using technology of the present application is provided. As shown, trampoline 100 includes a round jumping surface or mat 102 on which a jumper or user 104 is jumping. Mat 102 is connected to a frame 106 using a plurality of elastic member 108, such as, for example, springs or elastic bands. Generally, to avoid inadvertent pinching, elastic members 108 are covered by a fabric or foam covering 110. Mat 102 and frame 106 are shown as having a circular shape 112 which is currently the most commonly available shape. Frame 106 is supported by a plurality of legs 114. Legs 114 may be singular legs or U-shaped legs 114 as shown, which includes at least two vertical components 116 extending from the frame 106 to the ground and at least one horizontal component 118 connecting the two vertical components 116. Single legs 114 would have a single vertical component 116 and potentially a flared base.

Enclosure 140 includes a plurality of poles 142 extending above mat 102. Above is used as a term of orientation for the poles 142 and should not be considered limiting. Poles 142 may be coupled to every or every other vertical component 116 of legs 114 as shown. Poles 142 also may be coupled to frame 106 directly. Poles 142 are encased in a foam sleeve 144 that has an end cap 146 at the end of the tubular pole 142.

Flexible member 148 is coupled poles 142 to surround at least mat 102, but as shown may surround the entire frame 106. Flexible member 148 may be any conventional material, but is typically a nylon mesh or the like. There are a number of conventional ways to attach flexible member 148 to enclosure 140 known in the art that will not be explained herein except to the extent necessary to understand the technology of the present application. As shown, however, flexible member 148 is coupled to poles 142 using ties 150 as shown.

Figure 2:
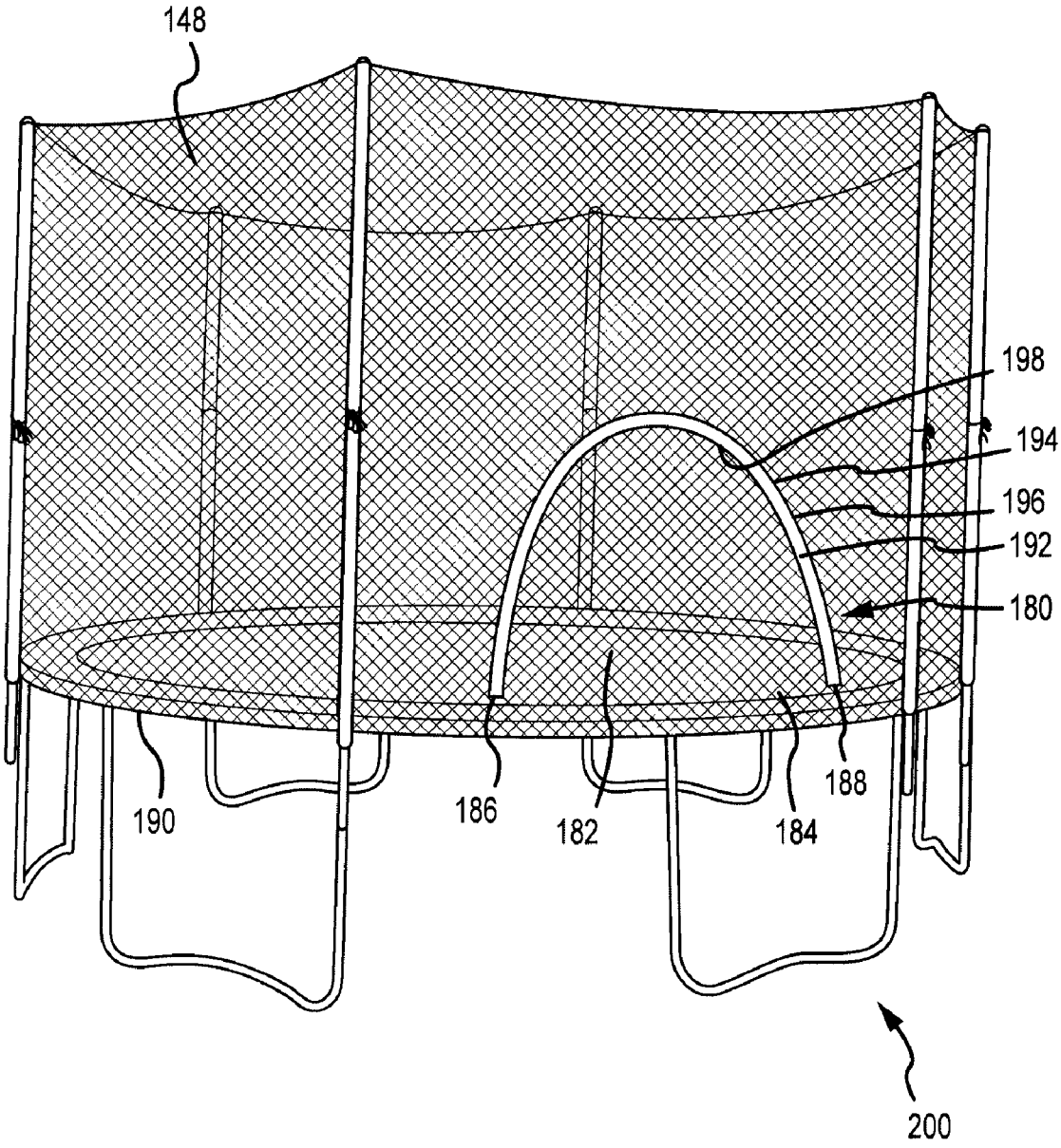
FIG. 2 is a front perspective view of the embodiment of FIG. 1.
Figure 3:
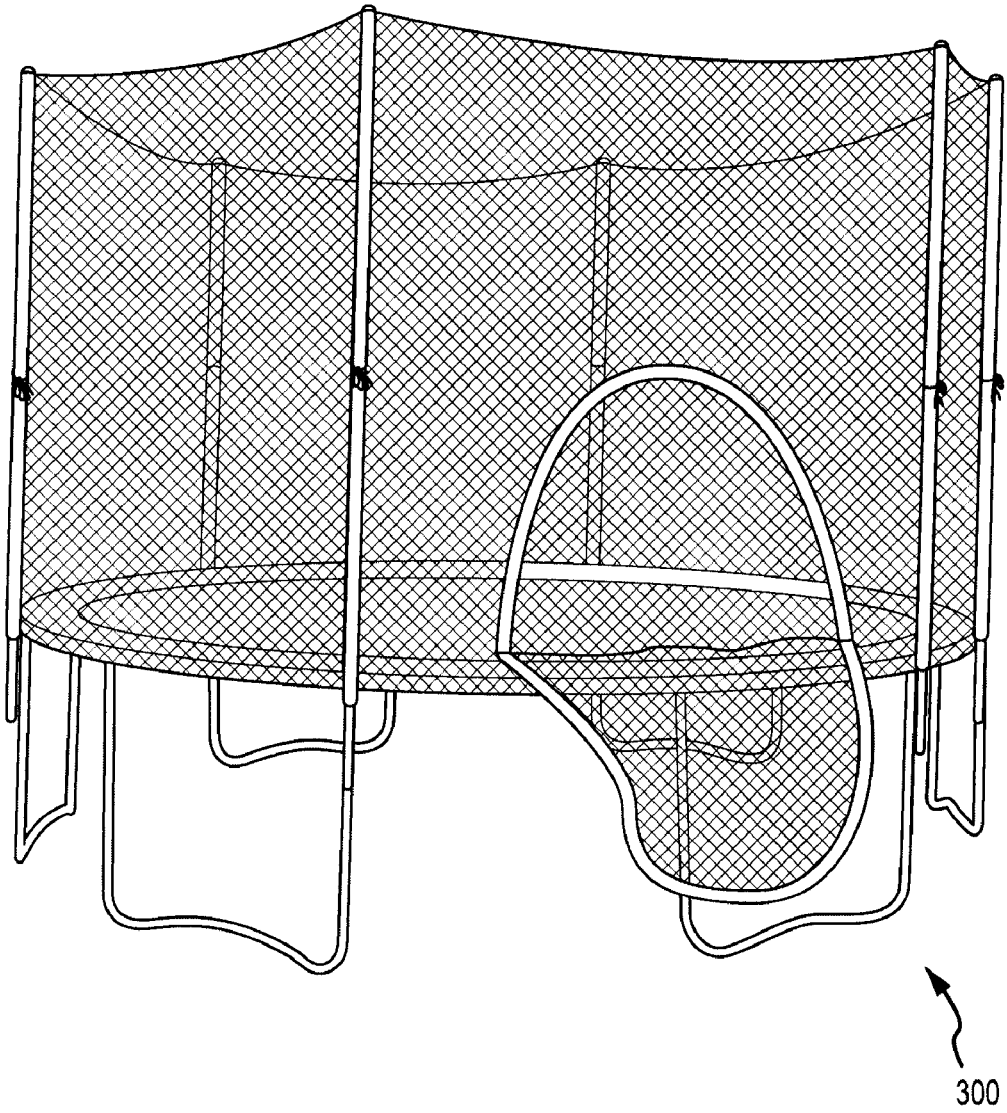
FIG. 3 is a front perspective view of the embodiment of FIG. 1 with the entry/exit open.

Referring now to FIG. 2, entry/exit 180 is shown in more detail. Entry/exit 180 is formed by a flexible member 182, that is conventionally the same material as flexible member 148, but may be different. Typically, flexible member 182 is formed of a mesh material. Flexible member 182 has a horizontal bottom edge 184 having a first end 186 and a second end 188. Horizontal bottom edge 184 and first and second ends 186, 188 may connect to a bottom hem 190 attached to flexible member 148. Flexible member 182 also has a arched edge 192 extending from first end 184 to second end 188. Arched edge 192 terminates in a hem 194. Similarly, flexible member 148 has an arched edge 196 corresponding to arched edge 192 terminating in a hem 198. Hems 194 and 198 would have corresponding fasteners 400 (see FIGS. 4, 5, and 6) to close the opening. As shown in FIG. 2, entry/exit 180 is in the closed position 200. Referring to FIG. 3, entry/exit 180 is shown in the open position 300. In this case, fasteners 400 are decoupled to allow flexible member 182 to be bundled at horizontal bottom edge 184 or to hang freely out of the entry way as shown in the alternative in FIG. 3. Notice, while described as arched, the entry/exit 180 could be any asymmetrical or symmetrical shape to hang vertically and out of the way from the enclosure to facilitate ingress and egress.

Figure 6:
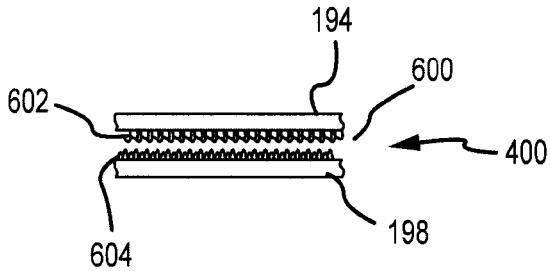
FIG. 6 is a view of an alternative closure device.
Figure 7:
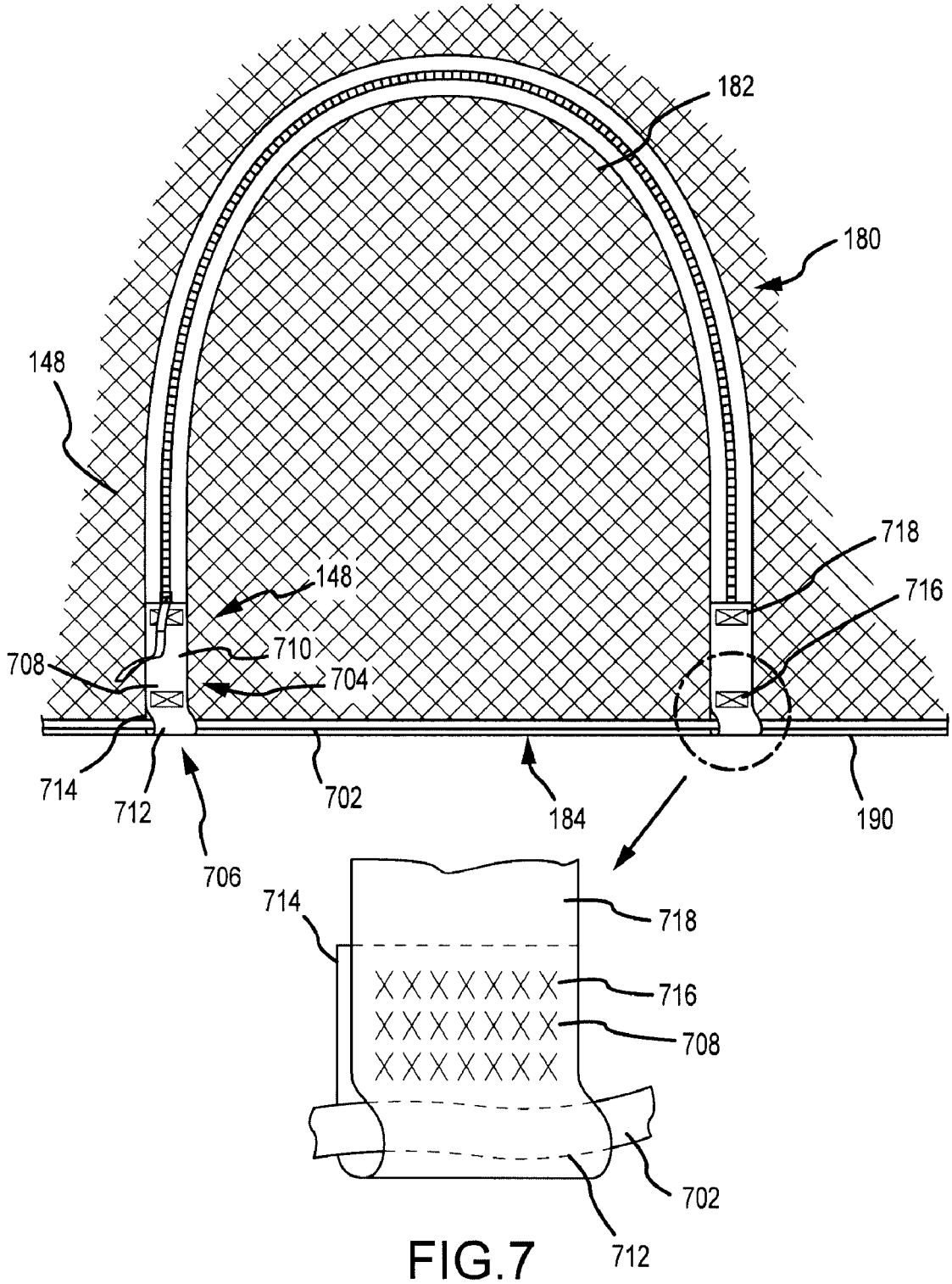
FIG. 7 is a view of a reinforced connection to the inhibit mesh tearing.

Referring to FIG. 6, entry/exit 180 having a reinforced connection to inhibit tearing is shown in more detail. As described above, entry/exit 180 is formed by flexible member 182 having a bottom edge 184 connected to bottom hem 190 of flexible member 148. A rope 702 to tighten the enclosure 140 about the trampoline may be provided. The rope 702 is generally known in the industry as a cinch rope because it is used to cinch the enclosure up against the trampoline mat and/or frame. To inhibit the flexible member 182 from tearing, one or two reinforced connections 704 may be provided at a base 706 of entry/exit 180. Reinforced connection 704 may be a length of heavy duty material with a first portion 708 connected to the first end 186 on a first side 710 external to the enclosed area. A body 712 of the reinforced connection extends from the first end 186 and wraps around rope 702 (or the connection of the various hems) and extends second a second portion 714 connected to first end 186 on a second side 720 internal to the enclosure at a point generally opposite where first portion 708 is connected to first end 186. First portion 708 and second portion 714 may be connected together through first end 186 via a stitch 716. Also, first portion 708 and/or second portion 716 may have an extended portion 718 that extends along hems 194 and 198.

Figure 4:
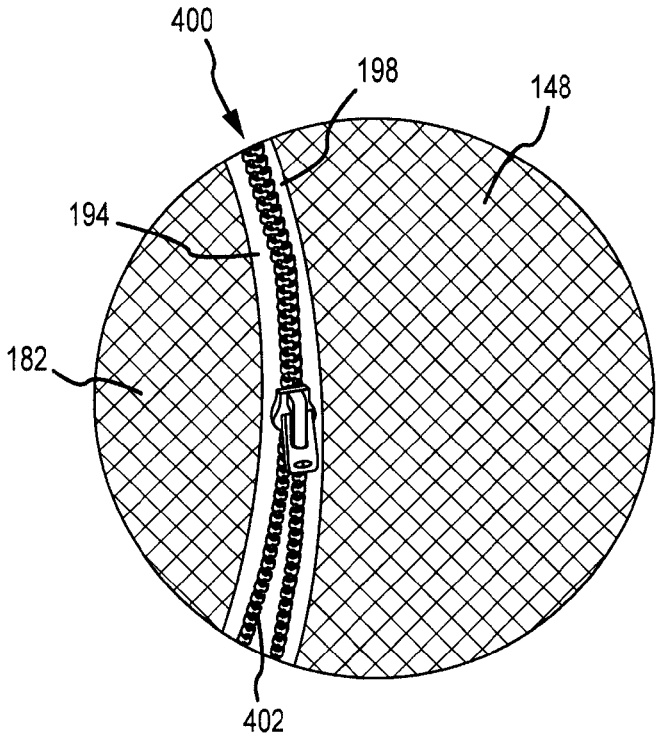
FIG. 4 is a plan view of a portion of the closure device.
Figure 5:
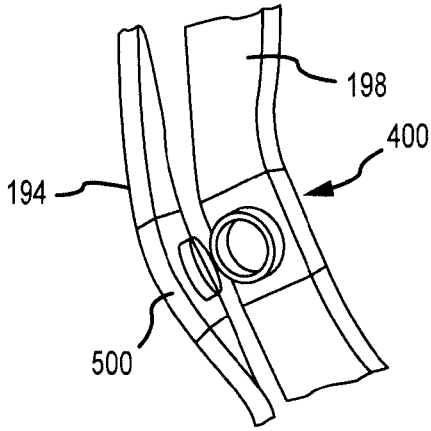
FIG. 5 is a view of an alternative closure device.

Referring now to FIG. 4, one possible fastener 400 is shown in more detail. Fastener 400 is shown between hem 194 of flexible member 182 and hem 198 of flexible member 148. As shown, fastener 400 is a conventional zipper 402. Zipper 402 could be replaced by numerous conventional devices, such as, for example, a plurality of ties 150, a male and female snap 500 (see FIG. 5), or strips of hook-and-loop material 600 comprising corresponding hook material 602 and loop material 604 (see FIG. 6).

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A trampoline and enclosure system comprising:

a trampoline frame;

a rebounding surface coupled to the trampoline frame;

a plurality of legs supporting the trampoline frame above a surface;

a plurality of poles extending above the trampoline frame;

a first flexible member coupled to the plurality of poles defining a jumping chamber; the first flexible member having at least a bottom hem extending around a substantial majority of the jumping chamber, the first flexible member having a first edge defining an entry/exit; and a second flexible member, the second flexible member having a second edge corresponding and releasably attachable to the first edge, the second flexible member having a bottom edge, wherein the entry/exit is closed by the second flexible member when the first edge is attached to the second edge and the entry/exit is open when the first edge is detached from the second edge, and wherein a bottom cinch rope is connected to the bottom edge and the bottom hem.

2. The trampoline and enclosure system of claim 1, wherein the rebounding surface is coupled to the trampoline using elastic members.

3. The trampoline and enclosure system of claim 2, wherein the elastic members are springs.

4. The trampoline and enclosure system of claim 2, wherein the elastic members are elastic bands.

5. The trampoline and enclosure system of claim 1, wherein the first edge and the second edge are corresponding arches.

6. The trampoline and enclosure system of claim 1, further comprising a zipper to releasably attach the first edge and the second edge.

7. The trampoline and enclosure system of claim 1, further comprising a hook material and a corresponding loop material to releasably attach the first edge and the second edge.

8. A trampoline and enclosure system comprising:

a trampoline frame;

a rebounding surface coupled to the trampoline frame;

a plurality of legs supporting the trampoline frame above a surface;

a plurality of poles extending above the trampoline frame;

a flexible member coupled to the plurality of poles defining a jumping chamber; the flexible member having at least a bottom hem extending around a substantial majority of the jumping chamber, and including a bottom cinch rope is connected to the bottom hem; and means for entering/exiting the jumping chamber contained in the flexible member, the means for entering/exiting the jumping chamber having a closed position and an open position, the open position being such that the means for entering/existing hangs substantially below the trampoline frame when the means for entering/existing is in the open position.

9. The trampoline and enclosure system of claim 8, wherein the means for entering/existing comprises a flap member releasably coupled to the flexible member along an edge.

10. The trampoline and enclosure system of claim 9, wherein the edge is symmetrical.

11. The trampoline and enclosure system of claim 9, wherein the edge is asymmetrical.

* * * * *